United States Patent [19]

Haas

[11] Patent Number: 4,768,316

[45] Date of Patent: Sep. 6, 1988

[54] CASEMENT WINDOWS

[75] Inventor: Fred Haas, Unionville, Canada

[73] Assignee: Viceroy Homes Limited, Scarborough, Canada

[21] Appl. No.: 47,323

[22] Filed: May 8, 1987

[30] Foreign Application Priority Data

Dec. 9, 1986 [CA] Canada ..... 524877

[51] Int. Cl.[4] ..... E04B 1/346

[52] U.S. Cl. ..... 52/71; 52/207; 52/204; 49/504

[58] Field of Search ..... 52/207, 208, 204, 211, 52/213, 217, 403, 71; 49/DIG. 2, 504, 63, 400, 401, 484, 501, 404, 381

[56] References Cited

U.S. PATENT DOCUMENTS

| | | | |
|---|---|---|---|
| 2,913,778 | 11/1959 | Alexander | 52/207 X |
| 4,432,163 | 2/1984 | Cassiere | 52/217 X |
| 4,524,112 | 6/1985 | Willert | 49/504 X |
| 4,640,061 | 2/1987 | Trumley | 52/71 |
| 4,676,026 | 6/1987 | Schreiner | 49/504 X |

FOREIGN PATENT DOCUMENTS

| | | | |
|---|---|---|---|
| 0053104 | 6/1982 | European Pat. Off. | 52/204 |
| 2155602 | 5/1973 | Fed. Rep. of Germany | 52/207 |
| 3049588 | 8/1982 | Fed. Rep. of Germany | 52/204 |
| 1460068 | 11/1966 | France | 49/DIG. 2 |
| 1001128 | 1/1957 | Netherlands | 52/207 |
| 355927 | 9/1961 | Switzerland | 49/401 |

*Primary Examiner*—Carl D. Friedman
*Assistant Examiner*—Creighton Smith
*Attorney, Agent, or Firm*—George A. Rolston

[57] ABSTRACT

A thermoplastic window having a window border to be received in a window opening, a first engagement device formed on the window border extending continuously along all sides, a window housing, a second engagement device extending continuously around all four sides of the housing, the second engaging device being interengageable with the first engagement device in mutually interlocking relation, and a locking strip for retaining the glazing.

11 Claims, 4 Drawing Sheets

CASEMENT WINDOWS

The invention relates to thermoplastic windows, and in particular to casement windows and picture windows.

BACKGROUND OF THE INVENTION

Casement and picture windows present a combination of problems, including aesthetic appeal, ease of installation, economy in manufacture, thermal insulation and weatherproofing.

Windows are available which satisfy one or some of these requirements, but generally speaking it has not been possible to achieve a satisfactory solution to all of these requirements in any one window.

Various different materials have been used in the past for such windows, with mixed results. Extrusion of a window frame in plastics material typically vinyl plastics materal offers numerous advantages from the viewpoint of economy, and weather resistance. However, in the past vinyl extruded windows of this type have generally speaking been either excessively complex in design or else have provided an inadequate seal either between the building fabric and the window frame, or between the frame and the glazing.

In addition, the method of installation of this type of window in the building fabric has not been satisfactory.

It is advantageous if the window design of a picture window is of two part construction consisting of a window border and flashing, of rectangular construction, designed to be fastened in position in the window opening, and a window housing attached to the window border.

A casement window will advantageously be of three-part construction, including the above components, and a glazing frame hinged on the housing.

BRIEF SUMMARY OF THE INVENTION

With a view to overcoming the various disadvantages noted above, the invention provides a window comprising a generally rectangular four-sided window border adapted to be received in a window opening in a building structure, first engagement means formed on said window border extending continuously along all four sides, a generally four-sided rectangular window housing including second engagement means extending continuously around all four sides thereof formed on said housing, said engagement means being interengageable with one another in mutually interlocking relation, and glazing in said housing.

More particularly, it is an objective of the invention to provide a window having the foregoing advantages including edge flashing means formed on said border, extending outwardly therefrom around all four sides thereof.

More particularly, the invention provides a window having the foregoing advantages including flange means formed on said window housing, shoulder means formed adjacent said flange means, said shoulder means and said flange means extending continuously around all four sides thereof, said flange means being adapted to receive glazing thereon, and a locking frame adapted to be secured to said housing for locking said glazing therein.

More particularly, the invention comprises a window having the foregoing advantages wherein the first engagement means on said window border is in the form of upstanding continuous tongues, and abutment means formed on said tongues, and wherein said second engagement means on said window housing is in the form of a continuous channel, adapted to receive said tongues, and trap said abutment means therein.

More particularly, it is an objective of the invention to provide a picture window in which the window housing provides a ledge on which the glazing is placed, and in which a locking strip is provided which makes a friction fit with a recess in the housing, securing the glazing in position.

More particularly, it is an objective of the invention to provide a casement window in which the window housing has a ledge, and an edge flange meeting at right angles, and in which a glazing frame fits within the flange on the housing, and is adapted to lie on the ledge, and including a plurality of separate seals between the housing and the glazing frame, and in which a locking strip is adapted to make a friction fit with the glazing frame, securing glazing thereto, and including hinge means joining the glazing frame and the window housing, and window operating means extending therebetween for opening and closing the glazing frame relative to the housing.

More particularly, the invention comprises a window having the forgoing advantages in which the window housing also incorporates junction recesses which are adapted to register with like junction recesses in an adjacent window housing, and junction strip means interengageable with said junction recesses whereby to secure two said window frames together in back-to-back relation.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
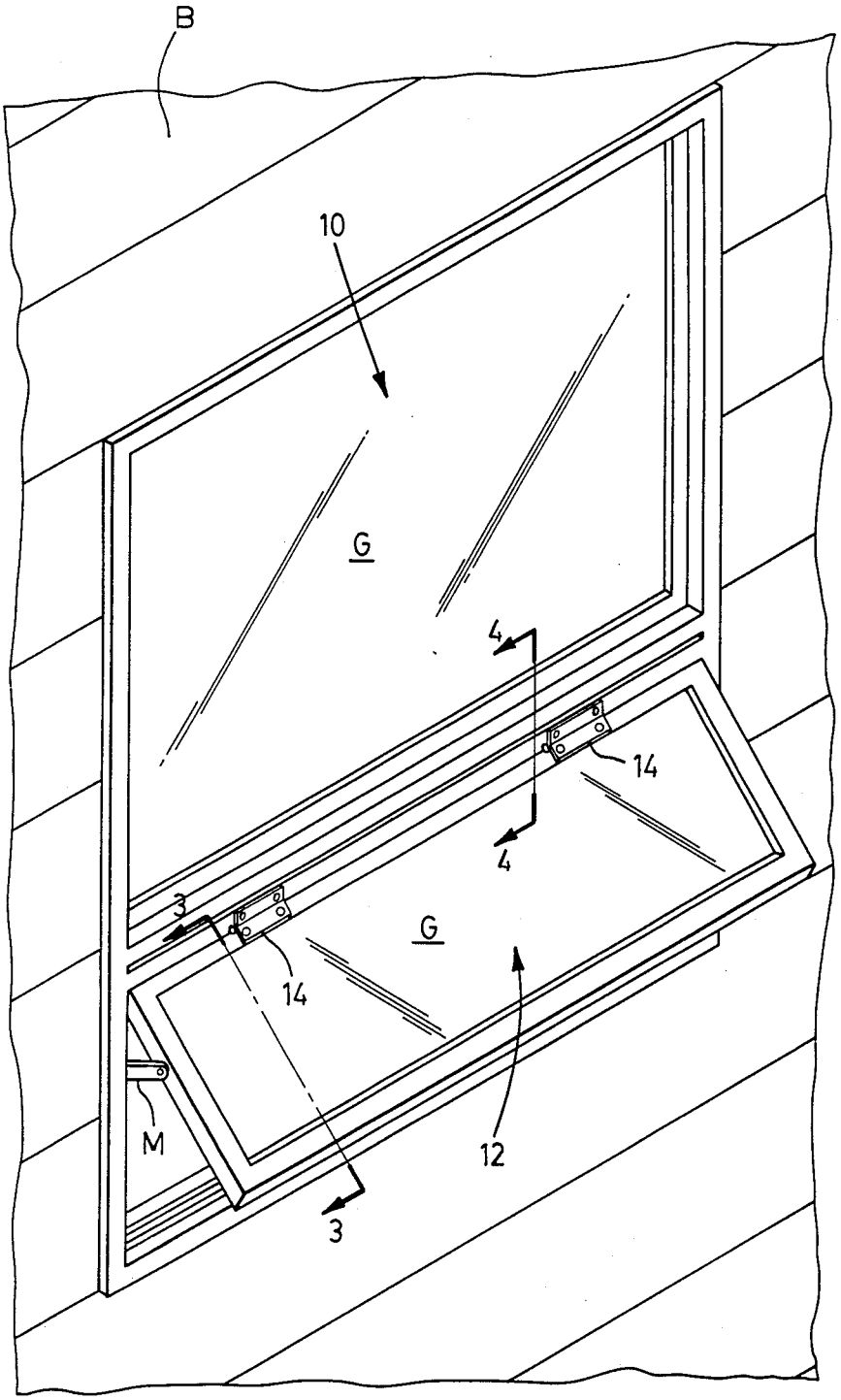
FIG. 1 is a general perspective illustration of both a picture window (shown in its open position) and a casement window, according to the invention, with a portion of a building structure shown for the sake of clarity.

Referring first of all to FIG. 1, it will be seen that the invention is illustrated in the form of a picture window indicated generally as 10 and a casement window 12, shown mounted in position in a building structure shown schematically as B. The structure B in the typical case will be part of a wall. It will of course be appreciated that this is by no means the only location in which such windows may find application. While the windows are described for the purposes of this illustration as picture and casement windows, it is not be regarded as limited or in any way restricted to a window only when used as a picture or casement window, but relates in general to windows having the characteristics described.

The terms "picture" and "casement" are also used in a generic sense. A picture window is generally understood to be a window which is fixed, and cannot be swung or raised or opened or closed, but is simply fixed relative to the rest of the building.

A casement window generally indicates a window which can be swung relative to the window opening, either outwardly, or in some cases, inwardly. The application of the invention to an inwardly swung casement window would require some degree of re-design and modification, but it is believed that such modifications would be apparent to persons skilled in the art. The term casement window also may imply that the hinges are located on one vertical side of the window, so that the window may be swung in and out on a vertical axis.

However, windows are also mounted so as to swing on a horizontal axis, and the term casement window is used in this context to describe any such a swinging window, whether it swings about a horizontal or a vertical axis.

As illustrated in FIG. 1, modern residential construction commonly employs a combination installation consisting of one or more picture windows, with one or more casement windows. The casement window may in some cases be located to swing on a horizontal axis, beneath the picture window. In other cases, a central window may be fixed and therefore constitutes a picture window, and two adjacent windows on either side may swing as a casement windows.

One significant and advantageous feature of the invention is that such a combination window installation can be pre-fabricated in the factory, in accordance with the present invention, and the various different window components may be interlocked and friction fitted together so as to provide a single composite window installation ready for installing in the window opening left in the building.

Figure 2:
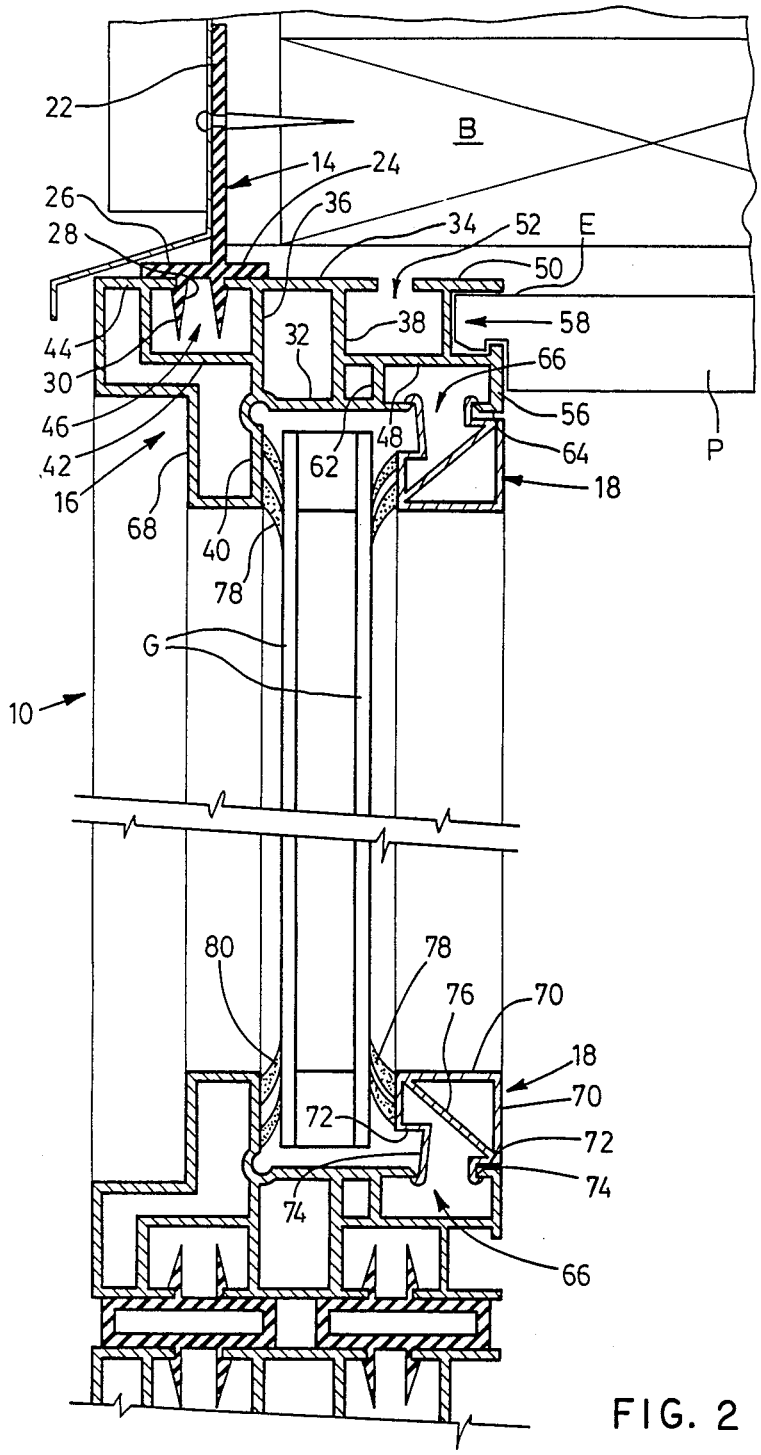
FIG. 2 is a section along 2—2 of FIG. 1.

Referring now to FIG. 2, the picture window 10 will be seen to comprise three basic components namely the border 14, the window housing 16, and the locking strip 18.

Glazing, indicated generally as G, is supported in the housing 16, and is retained therein by the strip 18.

Such glazing G may take various forms. It may be a single panel of glass, or multiple panels of glass to provide improved thermal insulation. Alternatively, it may be a single panel of plastic, or multiple panels of plastic such as "Plexiglass" (trade mark), and such plastic panels may be shaped or moulded or formed into a variety of different shapes all as is well known in the art.

The border 14 is intended to extend over a marginal area of the structure B around the window opening. Some exterior covering shown at 19 which may be for example brick, siding, stucco, and insulation, vapour barrier or the like, will overlap the border 14. Various different arrangements are well known in the art, and appropriate sealing or grout materials may also be used, in accordance with well known practice. Such covering materials, seals and the like are omitted for the sake of clarity.

As best shown in FIG. 2 the border 14, housing 16, and strip 18 are all formed of continuous extrusions, which are designed to interfit with one another in a manner described below.

Thus the border 14 comprises two side portions and top and bottom portions, cut from an identical extrusion. The border 14 comprises a planar flashing web 22, and generally right angled coplanar flanges 24 and 26 formed on the inner edge of web 22, flange 24 projecting toward the interior or rear and flange 26 projecting toward the exterior or front of the structure.

Suitable openings may be formed in the web 22 at intervals for fastening to the structure B.

Engagement means in the form of a pair of inwardly projecting arms 28 are formed on flanges 24 and 26. The arms 28 are formed in spaced-apart parallel location, and are designed to permit a limited degree of flexing towards one another. At their outer ends they are provided with retaining formations comprising hooks 30, the purpose of which will be readily apparent from the illustrations, and which is in any event described below.

Window housing 16 comprises a generally rectangular box-like section having an inner wall 32 defining a shoulder to receive glazing G, and a parallel outer wall 34. A front wall 36 and rear wall 38 extend between inner wall 32 and outer wall 34, normal thereto. A further front wall portion 40 extends from the junction of front wall 36 and inner wall 32, coplanar with front wall 36. Front wall portion 40 defines a ledge normal to shoulder 32 to receive glazing G.

Outer wall 34 is extended on either side of walls 36 and 38, to define free edges. An L-shaped channel wall 42 extends from the front of front wall 36, and then terminates in a T-shaped end wall 44. The free edges of walls 34 and 44 define a channel opening or recess 46 for purposes to be described below.

An L-shaped channel wall 48 extends rearwardly from rear wall 38 and connects with a T-shaped end wall 50. The oppositely facing free edges of walls 50 and 34 where they are juxtaposed define a channel opening or recess 52 for purposes to be described below.

Wall 48 extends parallel to wall 50, and terminates in a T-shaped rear end wall 56. End wall 56 together with the free edge of wall 50 define a channel shaped recess or opening 58 for purposes to be described below.

An extension of wall 32, extends parallel to to wall 48, and is supported by junction wall 62. A lip 64 is formed on wall 56 opposite and co-planar with wall 32, and together they define a channel shaped recess or opening 66 for purposes to be described below.

An exterior facing wall 68 of double L-shaped construction, connects between the free edges of walls 40 and 44 to provide an exterior finish and to provide additional support to wall 40.

The glazing G is held in place by means of locking strip 18. Strip 18 is of generally somewhat lopsided rectangular construction, having L-shaped walls 70 and two arm portions 72—72 extending therefrom, having fingers 74. Diagonal bracing strip 76 extends across the interior. The arms 72 can be squeezed together so that the fingers 74 make a snap fit within the channel 66.

Flexible resilient sealing strips 78 are welded or otherwise fastened to locking strip 18, to provide a substantial sealing pressure against the glazing G.

Similar sealing strips 80 are welded or otherwise secured to wall 40, and engage the opposite side of the glazing.

In order to provide a good joint to the building fabric B, the web 22 and flange 24 are provided at right angles to one another, so that the web 22 may overlap a substantial portion of the building fabric B, and be fastened thereto by any suitable fastening means.

The resilient locking arms 28 are adapted to squeeze together to enter and snap outwardly to lock in channel 46.

Channels 46 and 52 may also be used for interengaging two of the window housings back to back in a manner to be described below.

A drainage gutter 86 is formed between walls 36 and 40, for purposes to be described below.

It will be appreciated that FIG. 2 may be considered as representing either a horizontal section or a vertical section of a picture window, since all four sides will be the same.

Normally, the depth of the building fabric B will be considerably greater than the depth of the window 10, and accordingly some form of interior finish or trim will be required, to fill the space between the interior of the window 10 and the interior surface of the building fabric, ie., the finish of the interior wall.

In accordance with the invention, this may advantageously be provided by means of a trim panel P typically of wood, having a fastening edge portion E formed thereon, adapted to fit within and lock into channel 58. Panel P may be supported on the building fabric by any suitable means such as are well known in the art, by means of shims (not shown), typically being pieces of wooden shingle, so that the distance between the panel P and the building fabric B may be filled in, and some form of fastening (not shown) such as panel nails or the like may be fastened therethrough.

The interior edge of the panel P would normally be covered with a wooden moulding trim strip (not shown) such as is well known in the art.

Figure 3:
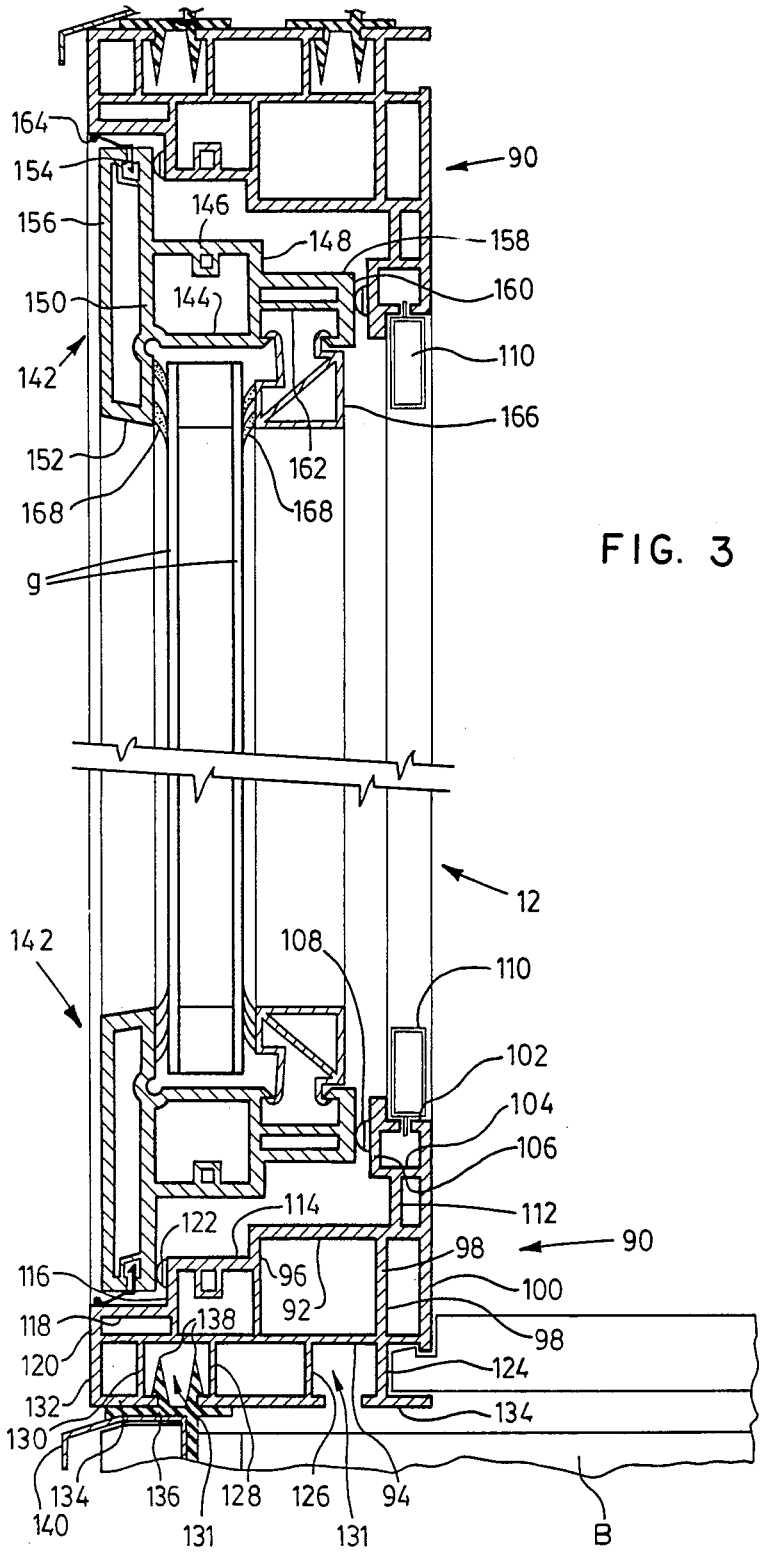
FIG. 3 is a section along 3—3 of FIG. 1.

Referring now to FIG. 3, it will be noted that this illustration shows a casement window 12 in accordance with the invention. Again, only one such section is illustrated, which may be either a horizontal or a vertical portion of the casement window, since all four sides are the same.

The only exception in this case will of course be the location of the hinges, which may be either on one vertical side, or one horizontal side, and also the location of the operating and locking mechanism.

The details of such hinges and operating and locking mechanism may vary from one design to another, but are essentially well known in the art, and accordingly are omitted from this description for the sake of clarity.

It will however be understood that in any such a casement window some form of hinging and some form of locking mechanism and in the majority of cases some form of mechanical operating mechanism will in fact be provided, in accordance with well known practice.

The casement window indicated generally as 12 in this embodiment comprises a generally four-sided rectangular window housing attached to the building fabric B. The housing indicated as 90 comprises a generally rectangular box-like centre section defined by inner wall 92, and a parallel outer wall 94. A front wall 96 and a rear wall 98 extend between inner and outer walls 92 and 94 normal thereto.

Walls 92 and 94 are extended rearwardly i.e. toward the interior, and join the rear facing wall 100, which defines the interior facing of the window housing 90. Facing wall 100 extends inwardly beyond wall 92, and joins with the seating box walls 102, 104, and 106. Walls 100, 102, 104, and 106 together define a rectangular-shaped seating box member, and carry, on the front surface of wall 106 a seal 108.

An insect screen frame 110 is supported within wall 102. It may be supported therein by any conventional means such as are currently used for supporting such insect screen frames in the window art.

A bracing wall 112 extends between wall 92 and wall 104 parallel to wall 100.

Outer wall 94 is extended forwardly, beyond wall 96, and a further pair of seating walls 114 and 116 extend between wall 96 and the forward extension of wall 94.

A still further pair of seating walls 118 and 120 extends between wall 116 and the forward extension of wall 94.

A further seal 122 is provided on the front surface of wall 116.

The three seating walls, namely walls 106, 116, and 118, provide separate contact surfaces for three separate seals in a manner to be described below.

Formed on the outwardly-directed surface of outer wall 94 are channel walls 124, 126, 128 and 130. A front facing wall 132 is also formed on the forward end of wall 94.

An outer facing wall 134, is formed on the outer edges of walls 132, 130, 128, 126 and 124, and defines openings therein registering with the spaces between respective pairs of walls 124, 126, and 128, 130, thereby defining two separate spaced-apart attachment recesses or channels 131 for purposes described below.

These attachment channels can receive border strip assemblies. These border strip assemblies each comprise a mounting wall 136, which is provided with two spaced-apart leg members 138, each of which is provided with hook portion, adapted to fit within the channels, and be retained therein. A flashing strip 139 extends normal thereto for attachment to the building fabric. A deflector strip 140 is attached on the wall 136, and is angled downwardly, whereby to cause any moisture to flow outwardly and downwardly.

In order to provide for a swinging casement window, a separate glazing frame or casement indicated generally as 142 is provided. Glazing frame 142 will of course be mounted on suitable hinges (not shown in FIG. 3) of a type well known in the art, which are connected to the window housing 90. The hinges will be located along one side, and will thus permit the casement 142 to swing relative to the housing 90.

As mentioned above, in FIG. 1 the casement is shown as mounted by means of hinges 14 located along its upper horizontal edge, so that it can swing outwardly and upwardly.

However it will of course be readily apparent that the hinges could be mounted on either of the side vertical portions or conceivably on the lower horizontal portion, and in each case the window would be considered for the purpose of the present description as a "casement" window.

In addition it will of course be appreciated that some form of control and locking mechanism M will normally be provided. Thus, in some cases, the control mechanism for holding the casement portion open will simply be a finger or strut. In other cases it will be some form of winding mechanism whereby the casement can be wound outwardly and inwardly by means of a handle.

In other cases a simple form of lock securing the casement to the housing will be provided.

All of these mechanisms are well known in the art relating to casement windows and require no further description. They are not illustrated in detail herein for the sake of clarity.

The casement window frame 142 will be seen to comprise an interior generally box-like centre section formed by inner wall 144 which defines a shoulder to receive glazing G, and parallel spaced-apart outer wall 146, a rear wall 148, and a front wall 150.

Front wall 150 is extended outwardly and inwardly from walls 146 and 144. The outward extension of wall 150 defines a bearing ledge wall normal to shoulder 144 to receive glazing G. On the inward and outward extensions of wall 150, inner and outer finish walls 152 and 154 are formed, and in turn they support a front facing wall 156.

On the rear wall 148, rear seating walls 158 and 160 are attached, and bracing wall 162 extends therebetween for added strength.

Wall 160 is adapted to engage and compress seal 108. Wall 150 is adapted to engage and compress seal 122.

An outward sealing strip 164 is attached to wall 154, and is adapted to engage wall 118 of window housing 90.

Walls 148 and 160 together define a channel, having a reduced width open mounth, which is adapted to receive a glazing or locking strip 166. Window glazing typically being the two glass panels indicated generally as g, forming a thermal glass panel, are located between wall 150, and glazing strip 166.

Any suitable seals such as 168 are provided on either side of the glazing g. In this way, it is possible to provide for a casement window having an extruded plastic window housing 90 and an extruded plastic casement frame 142 having a construction providing for three separate seals at different points, and providing for great flexibility in manufacture, and ensuring excellent service throughout a long life.

Figure 4:
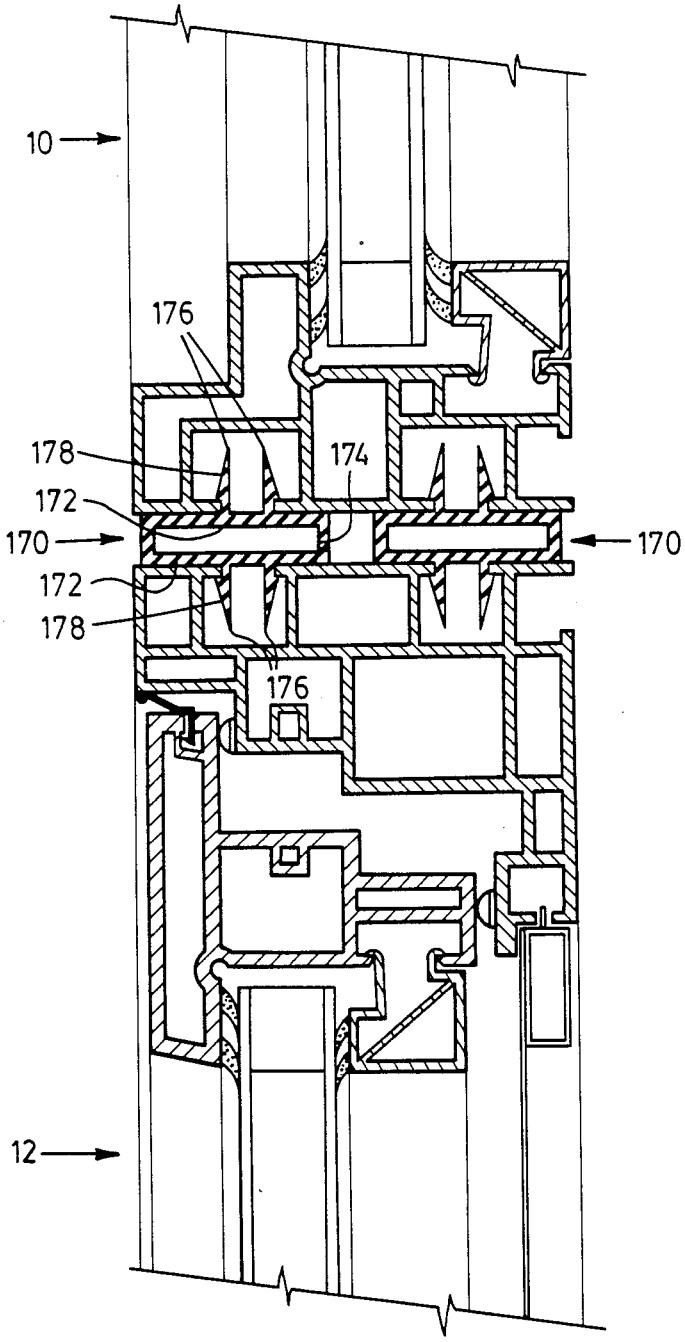
FIG. 4 is a section along 4—4 of FIG. 1 with the casement window in a closed position.

Referring now to FIG. 4, it will be seen that the windows in accordance with the invention may be joined together to provide a composite window to fill a larger overall opening in a building.

It will be appreciated that this composite window formed by associating together two or more windows in accordance with the invention may either be a picture window and a casement window, as illustrated in FIG. 1, or may be two picture windows or two casement windows, or still greater numbers of windows in any combination, without limitation.

For the purposes of simplicity FIG. 4 illustrates the junction between a casement window and a picture window, but this is not intended to be limiting of the invention.

With reference now to FIG. 4, the picture window is illustrated as 10 and the casement window is 12, and in each case they will have the features as described and illustrated above in connection with FIGS. 2 and 3.

The reference numbers are not included herein for the sake of simplicity.

The windows 10 and 12 are shown joined together by means of junction strips indicated as 170. These junction strips comprise a generally rectangular box section having side walls 172 and end walls 174.

Formed on opposite side walls 172, and registering with one another, are pairs of attachment fingers 176 each having hook portions 178.

The fingers 176 and hook portions 178 are adapted to be received in respective channels 46, 52 and 131 already described in their respective windows 10 and 12. By providing two spaced-apart junction strips 170 having these features, the two windows may thus be secured together to provide a composite window, having great strength and rigidity, and being substantially insulated against weather conditions.

The foregoing is a description of a preferred embodiment of the invention which is given here by way of example only. The invention is not to be taken as limited to any of the specific feactures as described, but comprehends all such variations thereof as come within the scope of the appended claims.

What is claimed is:

1. A window adapted for use as a casement window and adapted to be associated with one or more adjacent windows and comprising:

a generally four-sided rectangular window housing, including ledge means, and shoulder means, a glazing frame adapted to fit within said shoulder means, and adapted to lie on said ledge means;

a plurality of separate seals between said housing and said glazing frame;

a locking strip attachable to said glazing frame for securing glazing thereon;

hinge means joining said glazing frame and said window housing, and window operating means extending therebetween for opening and closing said glazing frame relative to said housing;

junction recess means formed on said housing, extending continously around all four sides thereof, adapted to register with like junction recess means in an adjacent window housing;

junction strip means having junction formations on opposite sides interengageable with said junction recess means in both said window housings whereby to secure two said window housings together in back-to-back relation, and, glazing in said glazing frame.

2. A window as claimed in claim 1 and including:

a generally rectangular four-sided window border adapted to be received in a window opening in a building structure;

engagement means formed on said window border extending continuously along all four sides, and, said engagement means being interengageable with said junction recess means in mutually interlocking relation.

3. A window as claimed in claim 2 including edge flashing means formed on said border, extending outwardly therefrom around all four sides thereof.

4. A window as claimed in claim 1 including ledge means formed on said window housing, shoulder means formed adjacent said ledge means, said shoulder means and said ledge means extending continuously around all four sides thereof, said ledge means being adapted to receive glazing thereon, and a locking strip adapted to be secured to said housing for locking said glazing therein.

5. A window as claimed in claim 4, adapted for use as a picture window wherein a recess is provided in said window housing adjacent said ledge means on which the glazing is placed, and in which said locking strip means a pressure fit with said recess, securing the glazing in position.

6. A window as claimed in claim 1 including trim channel means on said housing, located on the inward side of said window, adapted to receive trim panel means therein.

7. A window as claimed in claim 1 wherein said rectangular housing comprises four identical extrusions, formed of thermoplastic material, each extrusion defining outer wall means, inner wall means spaced therefrom, junction wall means extending extending between said inner and outer wall means and defining a generally rectangular tube-like structure, front facing wall means connected between a forward edge of said outer wall means and a forward edge of said inner wall means.

8. A window as claimed in claim 7, within said glazing frame comprises a rectangular four-sided structure, formed of four identical extrusions, formed of thermoplastic material, and wherein said extrusions define inner and outer wall means, junction wall means extending between said inner and outer wall means, a bearing ledge wall for receiving said glazing thereon, front facing wall means connecting said inner and and outer wall means, and a continuous channel located adjacent said inner wall means for receiving said locking strip, and including sealing means on said ledge wall means and said locking strip, for engaging opposite sides of said glazing.

9. A window as claimed in claim 1 wherein said junction recess means includes two continuous channels formed parallel to one another in spaced apart relation, and wherein said junction strip means comprises a main strip body, defining two sides, and having two pairs of continuous tongues formed on each of said sides adapted to interengage with respective pairs of said continuous channels on adjacent window housings.

10. A window adapted to be associated with one or more adjacent windows and comprising:

a generally four-sided rectangular window housing;

junction recess means formed on said housing, extending continuously around all four sides thereof, a generally rectangular four-sided window border adapted to be received in a window opening in a building structure;

engagement means formed on said window border extending continuously along all four sides, said engagement means being interengageable with said junction recess means in mutually interlocking relation, said engagement means on said window border being in the form of upstanding continuous arms, and hook means formed on said arms, and wherein said junction recess means on said window housing includes a continuous channel adapted to receive said arms, and trap said hook means therein, and, glazing in said window housing.

11. A window adapted to be associated with one or more adjacent windows and comprising:

a generally four-sided rectangular window housing;

junction recess means formed on said housing, extending continuously around all four sides thereof, adapted to register with like junction recess means in an adjacent window housing;

said junction recess means including two continuous channels formed parallel to one another in spaced apart relation, junction strip means having a main strip body, defining two sides, and having two pairs of continuous tongues formed on each of said sides adapted to interengage with respective pairs of said continuous channels on adjacent window housings, whereby to secure two said window housings together in back-to-back relation, and, glazing in said window housing.

* * * * *